United States Patent [19]

Kauss

[11] Patent Number: 4,967,554

[45] Date of Patent: Nov. 6, 1990

[54] COMMONLY-PILOTED DIRECTIONAL CONTROL VALVE AND LOAD PRESSURE SIGNAL LINE RELIEVING SWITCHING VALVE

[75] Inventor: Wolfgang Kauss, Lohr-Wombach, Fed. Rep. of Germany

[73] Assignee: Mannesmann Rexroth GmbH, Lohr am Main, Fed. Rep. of Germany

[21] Appl. No.: 247,858

[22] Filed: Sep. 22, 1988

[30] Foreign Application Priority Data

Oct. 5, 1987 [DE] Fed. Rep. of Germany ..... 3733677

[51] Int. Cl.[5] ..... F15B 11/02

[52] U.S. Cl. ..... 60/452

[58] Field of Search ..... 91/432, 445, 446, 447, 91/32, 454; 60/426, 443, 444, 450, 452, 493

[56] References Cited

U.S. PATENT DOCUMENTS

| | | | |
|---|---|---|---|
| 3,096,690 | 7/1963 | Hayner | 91/461 |
| 3,906,840 | 9/1975 | Bianchetta et al. | 91/445 |
| 4,111,283 | 9/1978 | Hastings, Jr. | 91/445 X |
| 4,283,996 | 8/1981 | Jackson et al. | 91/447 |
| 4,353,289 | 10/1982 | Lonnemo | 91/445 X |
| 4,379,389 | 4/1983 | Liesener | 60/452 X |
| 4,425,759 | 1/1984 | Krusche | 60/452 X |
| 4,523,430 | 6/1985 | Masuda | 60/452 X |
| 4,542,678 | 9/1985 | Kochendorfer et al. | 91/445 X |
| 4,642,984 | 2/1987 | Dixen | 60/452 X |
| 4,697,498 | 10/1987 | Yoshikawa et al. | 91/420 |
| 4,712,377 | 12/1987 | Yoshida et al. | 60/444 |

FOREIGN PATENT DOCUMENTS

| | | | |
|---|---|---|---|
| 1027828 | 3/1984 | Canada . | |
| 0167818 | 6/1985 | European Pat. Off. . | |
| 40002 | 3/1984 | Japan | 60/452 |
| 1361769 | 7/1974 | United Kingdom . | |
| 1543408 | 4/1979 | United Kingdom . | |
| 2040402 | 8/1980 | United Kingdom . | |

*Primary Examiner*—Edward K. Look
*Assistant Examiner*—George Kapsalas
*Attorney, Agent, or Firm*—Burns, Doane, Swecker & Mathis

[57] ABSTRACT

A load-independent control device for hydraulic users has an initial position in which a control line transmitting a load pressure is connected with a tank. The control device has a control valve for the user and a switching valve, which can be controlled independently of the control valve, and has a cutoff position as well as a through position, in which it connects with the control line transmitting the load pressure to the tank.

6 Claims, 2 Drawing Sheets

COMMONLY-PILOTED DIRECTIONAL CONTROL VALVE AND LOAD PRESSURE SIGNAL LINE RELIEVING SWITCHING VALVE

BACKGROUND OF THE INVENTION

The invention relates to a load-independent control devices for hydraulic users such as hydraulic lift cylinders. Such control devices are used in hydraulic systems with intermittent operation which work on the principle of the load-sensing or the flow-regulation principle. An example of a suitable application would be for mobile machines with several hydraulic users.

In the known control devices for this purpose, the switching functions are linked directly with the volume flow control from and to the hydraulic user; i.e. they are dealt with through a single hydraulic component. This results in a restriction of the dynamics and precision of the control functions of the hydraulic component. For example this results in disadvantages for the response behavior to the extent that when the user line leading to the user is connected, a gradual buildup of pressure can always occur in the user line.

SUMMARY OF THE INVENTION

An object of the invention is to create a control device for hydraulic users that is capable of effecting improvement in response behavior and that has a less expensive design than control devices of this kind known from prior art.

In accordance with the invention, a design of a control device having a switching valve and a control valve makes it possible to separate the switching functions of the control device from its flow volume control functions. The switching valve can be actuated independently of the control valve. The separate development of the switching valve and control valve makes a simple valve design possible, which offers advantages in regard to both dynamics and precision in the control circuit The control device in accordance with the invention provides two modes of operating a hydraulic system, namely on the one hand a loss-free standby mode when the switching valve is set in the through position and on the other hand a highly dynamic load-sensing mode that is exceptionally precise in its response behavior when the switching valve is in its cuttoff position.

An arrangement in accordance with one aspect of the invention ensures that the switching of the hydraulic system from the standby operating mode to the load-sensing mode is completed before the control valve undertakes the volume flow control function for the hydraulic user.

Hydraulic actuation of both a switching valve for controlling whether the system is in a standby or load-sensing mode and a control valve can be accomplished advantageously with especially low expenditure through apparatus in which a control pressure source (or pressure differential) actuates the control valve to bring about a load sensing mode at a lower pressure and also actuates the control valve at a higher pressure.

Through a mechanical coupling between the control valve and the switching valve, taken in combination with a special design which permits separate actuation of the two valves and an independent control pressure input to the control valve above a certain limit value, it is possible to actuate both valves with only one control pressure without adversely affecting the functioning of the control device.

The combination of the switching valve with an unlocking piston for a check valve makes possible the use of the control device in accordance with the invention in hydraulic systems (for example, in a hydraulic power lift) that have a user branch that at times must be cut off so as to avoid leakage.

A control device in accordance with the invention can be used especially advantageously in hydraulic systems fed by a variable displacement pump. In hydraulic systems of this kind no substantial losses arise when the variable displacement pump is kept under load pressure, i.e. in the load-sensing operating mode. However, the invention can also be used with comparable advantages in hydraulic systems fed by a fixed displacement pump, provided that the regulation of the control valve and switching valve are adapted for a fixed displacement pump.

BRIEF DESCRIPTION OF THE DRAWINGS

Embodiments of the invention are described below in detail with reference to the accompanying drawings in which.

DESCRIPTION OF A PREFERRED EMBODIMENT OF THE INVENTION

Figure 1:
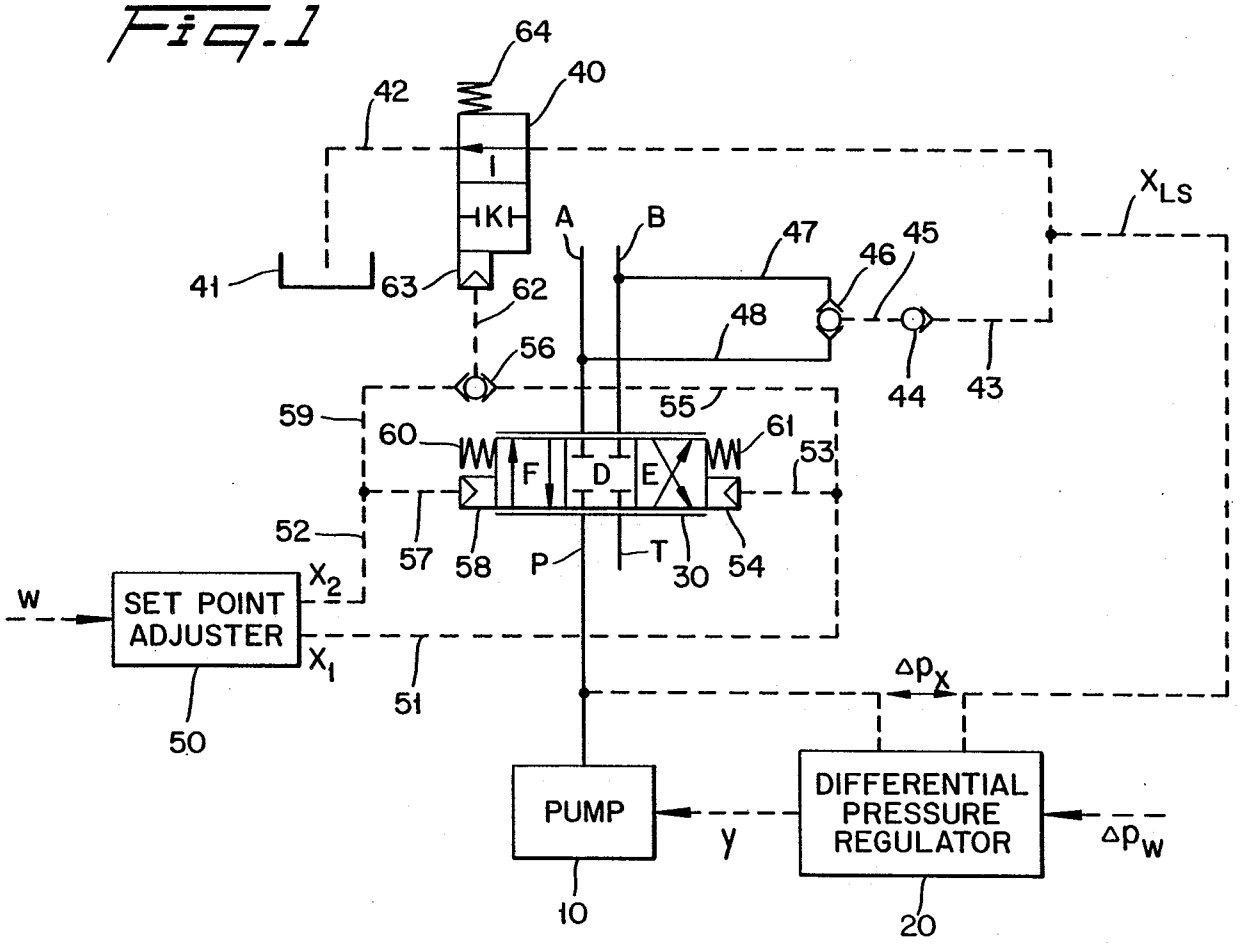
FIG. 1 diagrammatically shows a hydraulic system with control apparatus in accordance with a first embodiment of the invention.

A pump 10 can be a variable or constant displacement pump and which is controlled by a differential pressure control 20 in such a way that the pressure differential Px over a 4/3 control valve 30 remains constant. The pump 10 feeds user (e.g. lift cylinder) lines A or B, which leads to a hydraulic user that is not portrayed, through a pump line P via the 4/3 control valve 30. The lines A and B also can be discharged into a tank that is not portrayed through a tank line T connected to the 4/3 control valve.

A control line $X_{LS}$ can be shut off by means of a 2/2 switching valve 40 and can be discharged into a tank 41 through a line 42. This control line $X_{LS}$ is connected to the user line B or A downstream from the 4/3 serve valve 30 via a line segment 43, a check valve 44, a line segment 45, a two-way valve 46 and a branch 47 or 48 branching off from the pump line P upstream from the 4/3 control valve 30. This control or load-indicating line $X_{LS}$ is connected to the differential pressure regulator 20, which adjusts the pump 10 in accordance with the control pressure prevailing in the control line $X_{LS}$.

A set point adjuster 50 imposes a given desired pressure differential value W across the control pressure lines 51 and 52. The pressure difference between the control pressures $X_1$ and $X_2$ corresponds to the desired value W. The control pressure line 51 imposes its pressure $X_1$ on a control element 54 of the 4/3 control valve 30 by means of a branch 53 and on a two-way valve 56 by means of a branch 55. The control pressure line 52 imposes its pressure $X_2$ on control element 58 on the side of the piston slide of the 4/3 control valve 30 opposite to the control element 54 by way of a branch 57, and also imposes its pressure $X_2$ on the two-way valve 56 by means of a branch 59. The 4/3 control valve 30 is biased by means of springs 60 and 61 arranged on both sides of its piston slide in the direction of its initial indexing position, which position is its closed position D wherein all of its connections are blocked. A control line segment 62 leads from the two-way valve 56 to a control element 63 of the 2/2 switching valve 40, which is biased by a spring 64 toward its through position I.

In the initial position of the control device, the 4/3 control valve 30 is in its initial indexing or closed position D because of the forces exerted by the springs 60 and 61. The 2/2 two-way switching valve 40 is in its through position I because of the force of the spring 64. Accordingly, the load-indicating line $X_{LS}$ is connected to the tank 41 and is relaxed, so that the differential pressure regulator 20 switches the pump 10 over to standby operation.

As soon as the set point adjuster 50 is given an index value W, it causes imposition of pressure, based on an average pressure level, on the control pressure lines 51 and 52, with the control pressures $X_1$ and $X_2$ changing in opposite directions. The control pressure difference $X_1-X_2$ is set in accordance with the desired value W.

As soon as the larger of the two control pressures $X_1$ or $X_2$ reaches a switching pressure level, which may amount to up to half of the control range from $X_1$ to $X_2$, the control element 63 is strongly impacted by the pressure through the branch 55 or 59 and the two-way valve 56 and the control line segment 62. Consequently, the 2/2 switching valve 40 is pushed against the force of the spring 64 from its through position I into its closed position K. Pressure builds up in the load-indicating line $X_{LS}$, and the pump 10 is switched accordingly into the load-sensing operational mode.

The 4/3 control valve 30 is pushed out of its closed position D into one of its two operating positions E or F against the effect of the springs 61 and 60 as a consequence of the control pressures $X_1$ or $X_2$. The flow volume through the 4/3 control valve 30 is apportioned through the size of the opening area between the valve control edges which establish the passage through the valve which connect the pump line B with the appropriate user line A or B. This regulation of flow volume, through progressive movement of the control valve spool to increase or decrease the opening area through which the fluid must flow, does not depend on the load and corresponds to the size of the control pressure difference $X_1-X_2$, which controls the position of the valve spool.

When the control pressure difference $X_1-X_2$ is eliminated by the set point adjuster 50 and both control pressures $X_1$ and $X_2$ fall below the switching pressure level, the 2/2 directional switching valve 40 is returned to its through position I by the spring 64, and the 4/3 control valve 30 is returned to its initial indexing position (closed position D) by operation of the springs 60 and 61. Also, the load-indicating line $X_{LS}$ is relieved of pressure into the tank 41, so that the pump 10 is switched back to the standby operating mode.

The embodiment of the control switch portrayed in FIG. 2 differs from the embodiment previously described in connection with FIG. 1 in that the control pistons (not shown in the drawings) of the 4/3 control valve 30 and the 2/2 switching valve 40 are arranged on a common sliding axis C. A mechanical coupling 65 is arranged between, and can be brought up against, the ends of these control pistons which are opposite one another. On the control piston end of the 4/3 control valve 30 that is turned away from the coupling 65, the control piston is acted upon by a spring 60. On the control piston end of the 2/2 switching valve that is turned away from the coupling 65, the control piston is acted upon by the spring 64. The control element 63 of the 2/2 switching valve 40 has a larger control surface than the control element 54 of the 4/3 control valve 30. Both control elements 54 and 63 are acted upon by a single control pressure $X_1$.

In the initial condition of the control device, the 4/3 control valve 30 is in its initial indexing position D ( a closed position) because of the forces of the springs 60 and 64, the latter being conveyed to the control valve 30 by means of the mechanical coupling 65 so that the spring 64 not only sets the 2/2 switching valve 40 to its through position I but also is used for centering the control piston of the 4/3 control valve 30.

When control pressure $X_1$ is built up in the control line 51, it acts on the control element 63 of the 2/2 switching valve 40 through the branch 62 and the control element 54 of the 4/3 control valve 30 through the branch 53. Since the control surface of the control element 63 of the 2/2 switching valve 40 is larger than the control surface of the control element 54 of the 4/3 control valve 30, the 2/2 switching valve 40 is first pushed from its through position I into its closed position K, so that, as was described above, the pump 10 is switched from the standby operating mode into the load-sensing operating mode.

The control pressure $X_1$ rises further very quickly up to a neutral level at which the 4/3 control valve 30 is moved through the actuation of its control member 54 by the control pressure $X_1$ to its closed position D against the force of the spring 60. To avoid having the 4/3 control valve 30 leave its closed position D for a perceptible period of time after the switching pressure level (i.e. the level that triggers the switching process of the 2/2 switching valve 40) has been exceeded and before the neutral level is reached, the control pressure $X_1$ rises to the neutral level with great speed. After the control pressure $X_1$ has reached the neutral level, the 4/3 servo valve 30 can be used in its operating position F into which it is pushed by the spring 60 for regulating the flow volume from the pump line P to the user line A and from the user line B to the tank line T depending on the control pressure $X_1$. Movement of the valve 30 to position F is accomplished through a reduction of the control pressure $X_1$ below the neutral level, the lower limit of this reduction being predetermined by the switching pressure level.

A rise of the control pressure $X_1$ above the neutral level exceeds the force of spring 60 and can push the 4/3 control valve 30 into its operating position E for regulating the volume flow from the pump line P to the user line B and from the user line A to the tank line T depending on the control pressure $X_1$.

Figure 2:
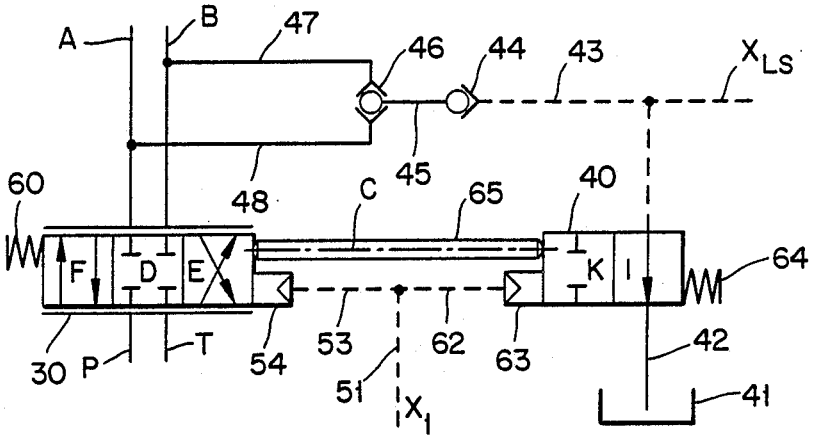
FIG. 2 shows a second embodiment of the control device.

The control device in accordance with FIG. 2 differs from the one in accordance with FIG. 1 in that only one control pressure $X_1$ is required for its actuation. In this the way, the elements necessary to produce the second control pressure $X_2$, e.g. magnetic or electrical control parts, are saved.

In the control device in accordance with FIG. 2 a part of the control pressure range is reserved for actuating the 2/2 switching valve 40, which triggers the switching process from the standby operating mode to the load-sensing operating mode; hence this part of the control pressure range is not available for flow volume regulation by the 4/3 control valve 30. In the event the control pressure $X_1$ is not present, the spring 64 of the 2/2 switching valve 40 is used to set the 4/3 control valve 30 in its initial indexing position or closed position D.

If, for example, a control pressure range from 0 to 20 bar is available for the control pressure $X_1$, it is possible through an appropriate arrangement of the springs 64 and 60 to set the switching pressure level at which the 2/2 switching valve 40 is pushed into its closed position K at 5 bar and the neutral level at which the 4/3 control valve is held in its closed position D at 12.5 bar, so that a control pressure range of 7.5 bar, namely between an upper limit value of 12.5 bar and a lower limit value of 5 bar, is available for volume flow regulation in the operating position F, and a control pressure range of 7.5 bar, namely between an upper limit value of 20 bar and a lower limit value of 12.5 bar, is also available for volume flow regulation in the operating position E.

Figure 3:
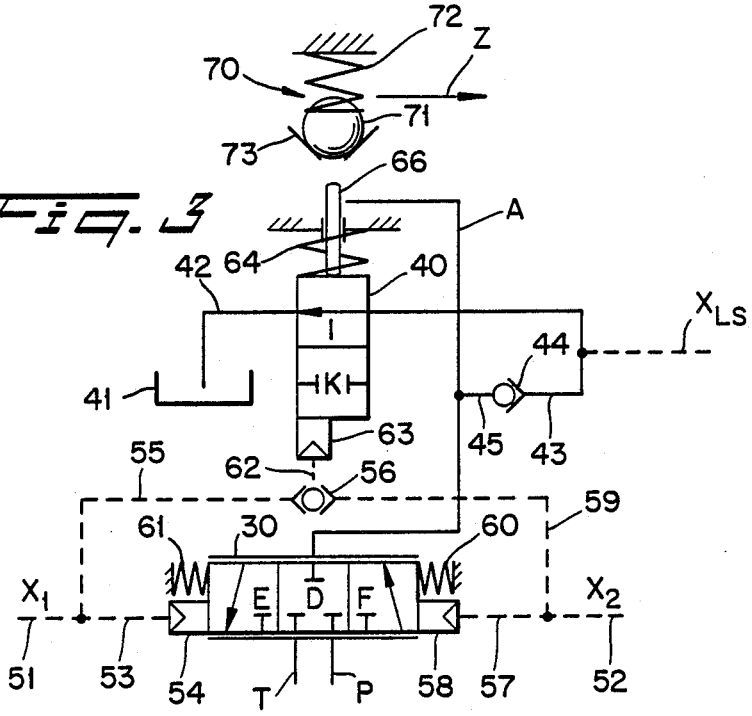
FIG. 3 shows a third embodiment of the control device.

It is possible to combine the 2/2 switching valve 40 in accordance with FIG. 3 with an actuating element for a check valve or cutoff valve 70 that can be unblocked; through this cutoff valve 70, which sits between the segments A and Z of the user line, it is possible to close off the user without a leak, as is frequently necessary, for example in cylinders with a weight load. To improve the clarity only a single user line A—Z is portrayed in FIG. 3, and the servo valve serving to regulate the volume flow is portrayed as a 3/3 control valve 30.

In FIG. 3, when the 2/2 switching valve 40 is pushed by the higher of the two control pressures $X_1$ or $X_2$ from its through position I into its closed position K for the load-sensing operational mode, a release piston 66 mounted on the 2/2 switching valve 40 opens the cutoff valve 70 by raising a blocking element 71 of the cutoff valve 70 from a valve seat 73 against the force of a spring 72. The connection between the user line segments A and Z is established, so that the volume flow to the user, if the 3/3 control valve 30 is in its operating position F, or the volume flow from the user, if the 3/3 control valve 30 is in its, operating position E, is regulated in accordance the pressure differential between the control pressures $X_1$ and $X_2$.

When the 2/2 switching valve is switched from its closed position K to its through position I for the standby operational mode through lowering or reducing the control pressures $X_1$ and $X_2$, the blocking element 71 is pressed against the valve seat 73 by the spring 72, so that the cutoff valve 70 closes and the segment Z of the user line A—Z is hermetically closed so that leakage will not occur.

Thus, the invention provides a load-independent control device for hydraulic users in the initial position of which a control line that regulates a load pressure is connected with a tank. The control device has a control valve for the user and a switching valve that can be controlled independently of the servo valve and has a closed position as well as a through position in which it connects the control line regulating the load pressure to the tank.

What is claimed is:

1. A control apparatus for a hydraulic user comprising a control valve for connecting a source of hydraulic load pressure to the hydraulic user and to a control line; a switching valve movable between a blocking position blocking said control line from a tank and a through position communicating said control line with said tank; means biasing said control valve and said switching valve to respective initial positions, said initial position of said control valve comprising a blocking position, and said initial position of said switching valve comprising its through position; a source of hydraulic control pressure; means connecting said source of hydraulic pressure to both said control valve and said switching valve for moving said control valve to an operating position thereof and for moving said switching valve to its blocking position, such that said switching valve is moved to its blocking position before said control valve is moved to said operating position.

2. A control apparatus according to claim 1, wherein said switching valve is arranged to be moved from its through position to tis blocking position with a smaller control pressure than that which moves the control valve from its initial position to its operating position.

3. A control apparatus according to claim 1, wherein a spool of said control valve and a spool of said switching valve are arranged on a common sliding axis and have their mutually facing ends interconnected by means of a mechanical coupling and have their oppositely facing ends loaded by springs which shift the control valve back into its initial position when the control pressure falls below a preset limit value, control elements mounted on only said mutually facing ends of said spools, said control elements arranged to be impacted by control pressure, a control surface provided on the control element of the switching valve being larger than a control surface provided on the control element of the control valve.

4. A control apparatus according to claim 1, wherein said source of hydraulic load pressure comprises a pump, means operably connected to said control line and said pump for regulating said hydraulic load pressure in accordance with hydraulic pressure in said control line.

5. A control apparatus according to claim 4, wherein said pump is a variable displacement pump.

6. A control apparatus according to claim 1, wherein said switching valve is arranged to be switched from its through position to its blocking position by a smaller control pressure than that which switches the control valve from its initial position to its operating position.

* * * * *